US011223123B2

(12) United States Patent
Lee et al.

(10) Patent No.: US 11,223,123 B2
(45) Date of Patent: Jan. 11, 2022

(54) RADIO-WAVE-TRANSMISSIVE COVER OF VEHICLE RADAR

(71) Applicants: Hyundai Motor Company, Seoul (KR); Kia Motors Corporation, Seoul (KR); MOBASE Co., Ltd., Incheon (KR)

(72) Inventors: Ill Joo Lee, Seoul (KR); Seung Chan Hong, Gyeonggi-do (KR); Byeong Jun Son, Seoul (KR)

(73) Assignees: Hyundai Motor Company, Seoul (KR); Kia Motors Corporation, Seoul (KR); MOBASE Co., Ltd., Incheon (KR)

( * ) Notice: Subject to any disclaimer, the term of this patent is extended or adjusted under 35 U.S.C. 154(b) by 0 days.

(21) Appl. No.: 16/896,808

(22) Filed: Jun. 9, 2020

(65) Prior Publication Data

US 2021/0184343 A1 Jun. 17, 2021

(51) Int. Cl.

| | |
|---|---|
| ***H01Q 1/42*** | (2006.01) |
| ***H01Q 1/40*** | (2006.01) |
| ***H01Q 17/00*** | (2006.01) |
| ***H01Q 1/32*** | (2006.01) |

(52) U.S. Cl.

CPC ..... *H01Q 1/405* (2013.01); *H01Q 1/32* (2013.01); *H01Q 1/421* (2013.01); *H01Q 17/007* (2013.01)

(58) Field of Classification Search

CPC ..... H01Q 1/405; H01Q 1/421; H01Q 1/32; H01Q 17/007

See application file for complete search history.

(56) References Cited

U.S. PATENT DOCUMENTS

| | | | | |
|---|---|---|---|---|
| 6,328,358 | B1 | 12/2001 | Berweiler | |
| 7,619,575 | B2 | 11/2009 | Kamiya et al. | |
| 8,287,990 | B2 * | 10/2012 | Maeda | H01Q 1/3233 428/195.1 |
| 2010/0028610 | A1 * | 2/2010 | Fujii | H01Q 1/3233 428/164 |
| 2010/0072058 | A1 | 3/2010 | Chiang et al. | |
| 2011/0273356 | A1 * | 11/2011 | Kawaguchi | C23C 14/35 343/873 |
| 2016/0130176 | A1 * | 5/2016 | Cho | H01Q 1/3233 428/216 |
| 2018/0029333 | A1 * | 2/2018 | Ogisu | C23C 14/02 |
| 2018/0250856 | A1 * | 9/2018 | Watanabe | C23C 14/14 |

FOREIGN PATENT DOCUMENTS

| | | |
|---|---|---|
| CN | 101676436 A | 3/2010 |
| KR | 101586369 B1 | 1/2016 |

* cited by examiner

*Primary Examiner* — Hoang V Nguyen

(74) *Attorney, Agent, or Firm* — Mintz Levin Cohn Ferris Glovsky and Popeo, P.C.; Peter F. Corless

(57) ABSTRACT

Disclosed is a radio-wave-transmissive cover of a vehicle radar, which exhibits a metallic color and is imparted with improved radio-wave transmission performance. The radio-wave-transmissive cover may include an optical film formed by simultaneously depositing an aluminum (Al) material and a low-melting-point material, such that a radio wave radiated from an antenna of a radar, for example, provided in a vehicle is transmitted. The radio-wave-transmissive cover includes a substrate, and an optical film including aluminum (Al) and a low-melting-point metal having a melting point less than the melting point of aluminum (Al) on the surface of the substrate.

12 Claims, 9 Drawing Sheets

[FIG. 3B]

| Classification | #1 | #2 |
|---|---|---|
| Al (at%) | 72.4576 | 84.0295 |
| In (at%) | 27.5424 | 15.9705 |
| SEM |  |  |
| Propagation loss(dB) | -0.16 | -0.10 |

| Classification | #3 | #4 |
|---|---|---|
| Al (at%) | 85.9914 | 88.7543 |
| In (at%) | 14.0086 | 11.2457 |
| SEM |  |  |
| Propagation loss(dB) | -29.61 | -32.91 |

| Classification | #5 | #6 |
|---|---|---|
| Al (at%) | 58.6481 | 69.4118 |
| Sn (at%) | 41.3519 | 30.5882 |
| SEM |  |  |
| Propagation loss(dB) | -0.22 | -16.61 |

| Classification | #7 | #8 |
|---|---|---|
| Al (at%) | 77.2926 | 81.9444 |
| In (at%) | 22.7074 | 18.0556 |
| SEM |  |  |
| Propagation loss(dB) | -28.02 | -35.09 |

RADIO-WAVE-TRANSMISSIVE COVER OF VEHICLE RADAR

CROSS REFERENCE TO RELATED APPLICATION

The present application claims priority to Korean Patent Application No. 10-2019-0167379, filed Dec. 16, 2019, the entire content of which is incorporated herein for all purposes by this reference.

TECHNICAL FIELD

The present invention relates to a radio-wave-transmissive cover of a vehicle radar. The radio-wave-transmissive cover of a vehicle radar may exhibit a metallic color and be imparted with improved radio-wave transmission performance by simultaneously depositing an aluminum (Al) material and a low-melting-point material.

BACKGROUND

Recently, with increased interest in autonomous vehicles, demand for vehicle radar technology that enables autonomous movement of automobiles has been increased.

A representative example of application of vehicle radar technology is a smart cruise system.

The smart cruise system detects the movement of a preceding vehicle using a radar device provided in front of a vehicle and thus controls the engine and brakes thereof so that the vehicle accelerates or decelerates, which makes it possible to avoid preceding vehicles and change lanes, or to accelerate to an initially set speed and then maintain constant-speed driving when there is no preceding vehicle.

In order to realize such a smart cruise system, the vehicle is equipped with a radar device and collects information on the movement of preceding vehicles and on changes in the surrounding environment through the transmission and reception of a laser beam emitted from a radar.

In general, the radar device includes an antenna for transmitting and receiving radio waves, internal electronic parts such as a millimeter-wave RFIC (radio frequency integrated circuit), and a radome for protecting the same. Further, a transmissive cover for protecting the radar device is disposed in front of the radome. Typically, the transmissive cover is provided on the front grille of the vehicle.

FIG. 1 is a view showing a conventional radio-wave transmission module of a vehicle radar. The radio wave radiated from an antenna 10 of a radar device provided in a vehicle is sequentially transmitted through a radome 20 and a transmissive cover 30 and is then radiated forwards.

The radio wave radiated from the antenna 10 is changed in terms of wavelength and is attenuated due to the dielectric permittivity of the medium through which the radio wave is transmitted.

Further, as shown in FIG. 1, the radio wave radiated from the antenna 10 is mostly transmitted through the radome 20 to the transmissive cover 30 when coming into contact with the radome 20, but a portion thereof is reflected on the radome 20. When the radio wave that is radiated from the antenna 10 and is then incident on the radome 20 is defined as a first incident wave L1 and when the radio wave reflected on the radome 20 is defined as a first reflection wave R1, the transmittance of the radome 20 is a value obtained by subtracting the first reflection wave R1 from the first incident wave L1. Further, when the radio wave that is transmitted through the radome 20 and is then incident on the transmissive cover 30 is defined as a second incident wave L2 and when the radio wave reflected on the transmissive cover 30 is defined as a second reflection wave R2, the transmittance of the transmissive cover 30 is a value obtained by subtracting the second reflection wave R2 from the second incident wave L2.

The radio wave radiated from the antenna 10 is partially reflected while being transmitted through the radome 20 and the transmissive cover 30. Accordingly, only a transmission wave L3 obtained by subtracting the first reflection wave R1 and the second reflection wave R2 from the first incident wave L1 is radiated forwards.

Therefore, in order to improve the transmission and reception efficiency of the radio wave radiated from the antenna 10, it is important to improve the radio-wave transmittance of the radome 20 and the transmissive cover 30.

Meanwhile, since the radome 20 and the transmissive cover 30, particularly the transmissive cover 30, are exposed to the outside of the vehicle, a metallic color needs to be realized in order to ensure a sense of unity with surrounding vehicle parts. To this end, a metal material for realizing a metallic color is deposited on a substrate including a plastic material, and the resultant part is then used.

In the case when the metal material is deposited on the substrate to manufacture a transmissive cover, the transmissive cover may have a metallic color, but the radio-wave transmission performance and durability are not ensured. Therefore, research has been continuously conducted on the selection and combination of the metal material deposited on the substrate.

The contents described as the background art are only for understanding the background of the present invention, and should not be taken as corresponding to the related arts already known to those skilled in the art.

SUMMARY

In a radio-wave-transmissive cover of a vehicle radar, which may exhibit a metallic color and is imparted with improved radio-wave transmission performance by simultaneously depositing inexpensive aluminum (Al) and low-melting-point materials (e.g., low-melting-point metal or alloy components) on a substrate so that the surface mobility of the aluminum is increased, thus forming an optical film having a fine island structure. The radio-wave-transmissive cover of a vehicle radar may be formed of material through which a radio wave radiated from an antenna of a radar provided in a vehicle is transmitted.

In an aspect, provided is a radio-wave-transmissive cover includes a substrate (e.g., plastic material), and an optical film including aluminum (Al) and a low-melting-point metal having a melting point less than the melting point of aluminum (Al) on the surface of the substrate.

The optical film may be formed by depositing aluminum (Al) and the low-melting-point metal together.

The content of aluminum (Al) may be greater than the content of the low-melting-point metal in the optical film.

The low-melting-point metal may include indium (In) or tin (Sn). Preferably, the optical film may suitably include an amount of about 70 to 85 at % of aluminum (Al) and an amount of about 15 to 30 at % of indium (In). Alternatively, the optical film may suitably include an amount of about 50 to 60 at % of aluminum (Al) and an amount of about 40 to 50 at % of tin (Sn).

The optical film may be arranged in the form of an island structure having a size of about 100 nm or less on the surface of the substrate.

The term "island structure" as used herein refers to a structural layout that includes a first material (e.g., object, particles or substrate that is floating or raised) having a certain shape surrounded by a second material. For example, a first material (e.g. film forming material) may form a deposit on a surface of the substrate such that the first material deposit may be raised on the surface of the substrate as maintaining certain closed shapes (e.g., circular, oval, or fine particles or irregular particles). The propagation loss of the radio wave transmitted through the optical film may be about 5% or less.

The optical film may have a silver color.

The radio-wave-transmissive cover may further include a protective layer including a resin, which is formed on one or both surfaces of the optical film.

In an aspect, also provided is a radio-wave-transmissive cover of a vehicle radar through which a radio wave radiated from an antenna of a radar provided in a vehicle is transmitted. The radio-wave-transmissive cover may include a substrate including a plastic material and an optical film formed by arranging a film-forming material including a metal material in the form of an island structure having a size of about 100 nm or less on the surface of the substrate.

The optical film may be formed by depositing the film-forming material.

The film-forming material may include aluminum (Al) and a low-melting-point metal having a melting point less than the melting point of the aluminum (Al).

The content of aluminum (Al) may be greater than the content of the low-melting-point metal in the film-forming material.

The low-melting-point metal may include indium (In) or tin (Sn). Preferably, the material may include an amount of about 70 to 85 at % of aluminum (Al) and an amount of about 15 to 30 at % of indium (In). Alternatively, the film-forming material may include an amount of about 50 to 60 at % of aluminum (Al) and amount of about 40 to 50 at % of tin (Sn).

The propagation loss of the radio wave transmitted through the optical film may be about 5% or less.

The optical film may have a silver color.

The radio-wave-transmissive cover may further include a protective layer including a resin, which may be formed on one or both surfaces of the optical film.

Particularly, the type and content of the metal material deposited on the substrate may be set so that a film-forming material is deposited and arranged in the form of a fine island structure having a size of about 100 nm or less on the surface of the substrate when an optical film is formed, thereby ensuring excellent radio-wave transmission performance.

Further, inexpensive aluminum (Al) and indium (In) or tin (Sn) are mixed to be deposited on a substrate, thereby realizing a metallic color such as a silver color and increasing hardness.

Further provided is a vehicle that includes the radio-wave-transmissive cover as described herein.

Other aspects of the invention are disclosed infra.

BRIEF DESCRIPTION OF THE DRAWINGS

The above and other objects, features and advantages of the present invention will be more clearly understood from the following detailed description taken in conjunction with the accompanying drawings, in which:

FIGS. 3A and 3B are views showing exemplary radio-wave-transmissive covers of vehicle radars according to exemplary embodiments of the present invention;

DETAILED DESCRIPTION

Figure 1:
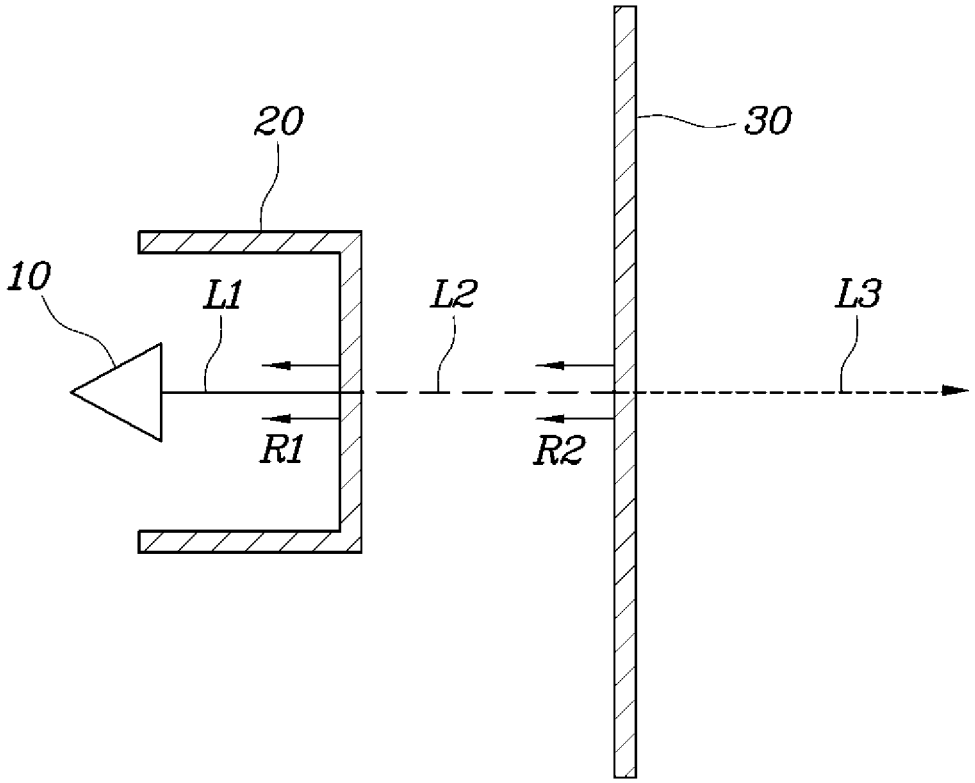
FIG. 1 is a view showing a conventional radio-wave transmission module of a vehicle radar.

Hereinafter, embodiments of the present invention will be described in more detail with reference to the accompanying drawings. However, the present invention is not limited to the embodiments disclosed below, but will be realized in various different forms, and the present embodiments are merely provided to complete the disclosure of the present invention and to fully inform those skilled in the art of the scope of the invention. Like reference numerals refer to like elements in the drawings.

In this specification, it should be understood that terms such as "comprise" or "have" are intended to indicate that there is a feature, a number, a step, an operation, a component, a part, or a combination thereof described on the specification, and do not exclude the possibility of the presence or the addition of one or more other features, numbers, steps, operations, components, parts, or combinations thereof. Further, when a portion such as a layer, a film, a region, or a plate is referred to as being "above" the other portion, it may be not only "right above" the other portion, or but also there may be another portion in the middle. On the contrary, when a portion such as a layer, a film, a region, or a plate is referred to as being "under" the other portion, it may be not only "right under" the other portion, or but also there may be another portion in the middle.

Unless otherwise indicated, all numbers, values, and/or expressions referring to quantities of ingredients, reaction conditions, polymer compositions, and formulations used herein are to be understood as modified in all instances by the term "about" as such numbers are inherently approximations that are reflective of, among other things, the various uncertainties of measurement encountered in obtaining such values.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Further, where a numerical range is disclosed herein, such range is continuous, and includes unless otherwise indicated, every value from the minimum value to and including the maximum value of such range. Still further, where such a range refers to integers, unless otherwise indicated, every integer from the minimum value to and including the maximum value is included.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

In an aspect, provided is a radio-wave-transmissive cover of a vehicle radar. In particular, the radio-wave-transmissive cover of the vehicle radar may be directly exposed to the outside when the transmissive cover is provided on the front grill of the vehicle thereby ensuring a sense of unity with the appearance of the vehicle and also realizing a metallic color corresponding to the front grill.

Figure 2:
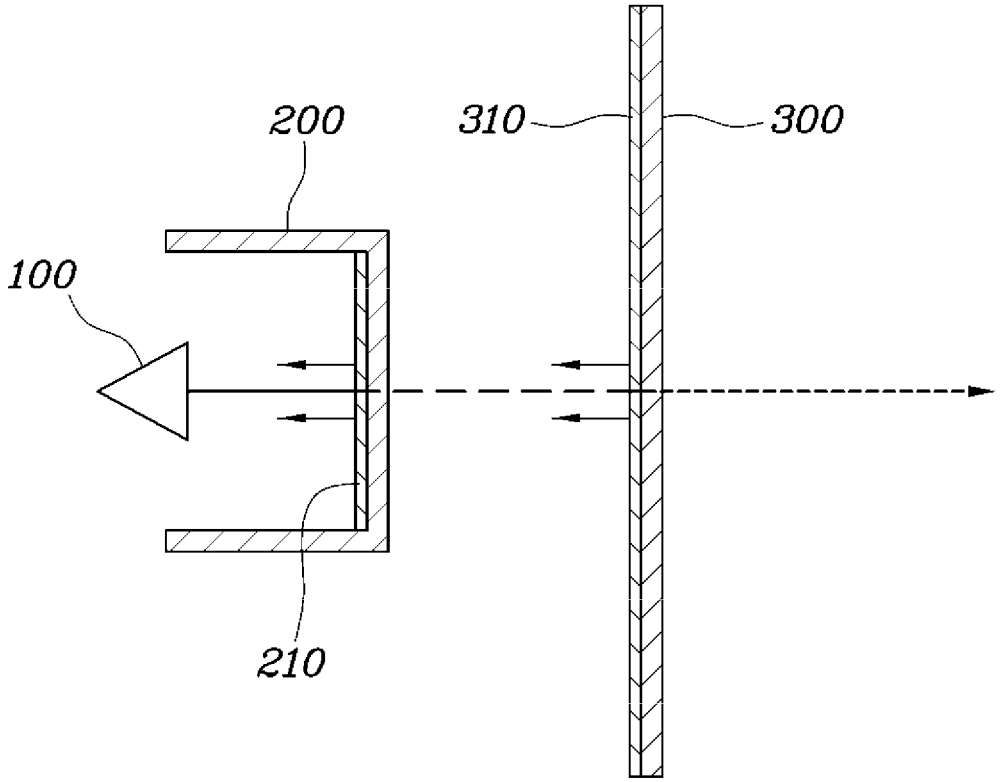
FIG. 2 is a view showing a transmission module to which an exemplary radio-wave-transmissive cover of a vehicle radar according to an exemplary embodiment of the present invention is applied.

FIG. 2 is a view showing a transmission module to which an exemplary radio-wave-transmissive cover of the vehicle radar according to an exemplary embodiment of the present invention is applied.

As shown in FIG. 2, in the radio-wave transmission module of the vehicle radar, a radome 200 and a transmissive cover 300 are sequentially disposed in front of an antenna 100 of the radar device provided in the vehicle. Therefore, the radio wave radiated from the antenna 100 is sequentially transmitted through the radome 200 and the transmissive cover 300 and is then radiated forwards. Optical films 210 and 310 may be formed on the radome 200 and the transmissive cover 300. Hereinafter, the transmissive cover on which the optical film may be formed will be described in order to reduce redundant description.

The radio-wave transmission module of the vehicle radar includes the antenna 100, the radome 200, and the transmissive cover 300. However, the radome 200 may also act as the transmissive cover, without having to provide a separate transmissive cover 300. The optical film is formed on the radome 200.

The radio-wave-transmissive cover of the vehicle radar may include a substrate 300, for example, including a plastic material, and an optical film 310 including aluminum (Al) and a low-melting-point metal having a melting point less than the melting point of aluminum (Al) on the surface of the substrate 300.

The substrate 300 may be a base component for shaping the transmissive cover, and may be manufactured by molding a plastic material. The substrate 300 means the transmissive cover.

The optical film 310 may be a layer for realizing a metallic color when the radio wave is transmitted by arranging the film-forming material including the metal material in the form of a fine island structure on the surface of the substrate 300.

In the case of the optical film 310, preferably, the film-forming material is deposited on the surface of the substrate 300 through a deposition process so as to be arranged in the form of a fine island structure. The process of forming the optical film 310 is not limited to the deposition process, and may be modified into any process for arranging the film-forming material in the form of a fine island structure on the surface of the substrate 300. Hereinafter, for the convenience of description, the process of forming the optical film 310 is assumed to be a deposition process.

In addition, FIG. 2 shows, as an example, that the optical film 310 may be formed so as to face a side where an antenna 100 is disposed, that is, the optical film is formed on the inwardly facing surface of the substrate 300, among the two surfaces thereof. However, in the present invention, the optical film 310 may be formed on the opposite surface of the surface facing the side where the antenna 100 is disposed, that is, the optical film may be formed on the outwardly facing surface, among the two surfaces of the substrate 300.

As the film-forming material, inexpensive aluminum (Al), which is capable of realizing a metallic color, and a low-melting-point metal having a melting point relatively less than the melting point of aluminum (Al) may be used.

Accordingly, as aluminum (Al) and the low-melting-point metal may be simultaneously deposited, the low-melting-point metal may increase the surface mobility of aluminum (Al) on the surface of the substrate 300, so that the material may be arranged in the form of a fine island structure having a size of about 100 nm or less.

The low-melting-point metal may be a metal or an alloy having a melting point less than the melting point (e.g., 660° C.) of aluminum (Al).

Examples of the low-melting-point metal having a melting point less than the melting point of aluminum (Al) may suitably include indium (In), tin (Sn), cadmium (Cd), lead (Pb), and zinc (Zn).

However, cadmium (Cd) and lead (Pb) are heavy metal contaminants that are classified as harmful materials in the industry, so it is preferable to exclude their use. In addition, zinc (Zn) has a melting point of about 420° C., which is not greatly different from the melting point (660° C.) of aluminum (Al). Accordingly, a mobility increase effect is not great during deposition.

Preferably, indium (In) and tin (Sn) may suitably be used as the low-melting-point metal.

In the film-forming material for forming the optical film, the content of aluminum (Al) may be greater than the content of the low-melting-point metal.

For example, when indium (In) is used as the low-melting-point metal, an amount of about 70 to 85 at % of aluminum (Al) and an amount of about 15 to 30 at % of indium (In) may be mixed to be deposited on the surface of the substrate, thus forming the optical film.

Further, when tin (Sn) is used as the low-melting-point metal, an amount of about 50 to 60 at % of aluminum (Al) and an amount of about 40 to 50 at % of tin (Sn) may be mixed to be deposited on the surface of the substrate, thus forming the optical film.

When the amounts of indium (In) and tin (Sn) added are below the above-described range, since the deposited film-forming material does not have sufficient mobility, thickness-direction growth (epitaxial growth) may occur immediately after the film-forming material is adsorbed on the surface of the substrate 300. Accordingly, there is a problem in that the radio-wave transmission performance is significantly reduced due to the increase in the thickness of the optical film. When the amounts of indium (In) and tin (Sn) that are added are above the above-described range, the size of the island structure may be increased, thus reducing the radio-wave transmission performance.

Therefore, the amounts of indium (In) and tin (Sn) that are added may be set within the above-described range in order to form the optical film 310 so that the film-forming material including aluminum (Al) and indium (In) or tin (Sn) may be arranged in the form of a fine island structure having a size of about 100 nm or less on the surface of the substrate 300, whereby an optical film having a propagation loss of about 5% or less may be formed. Further, the optical film 310 formed as described above may exhibit a silver color, which may be a metallic color.

Meanwhile, protective layers 320 and 330 may be further formed on the optical film 310 in order to protect the optical film 310.

Figure 3A:
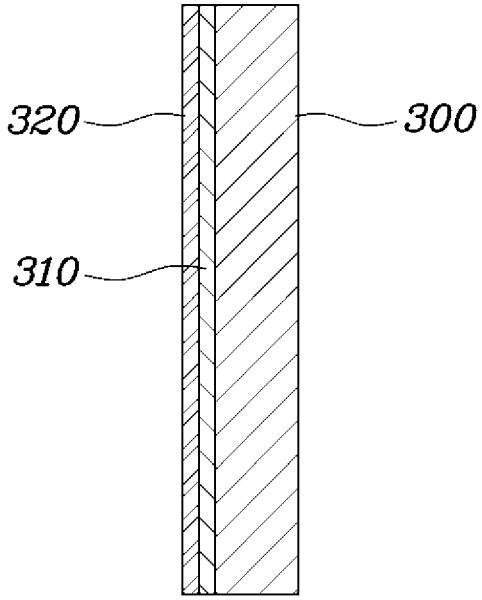
Figure 3A:
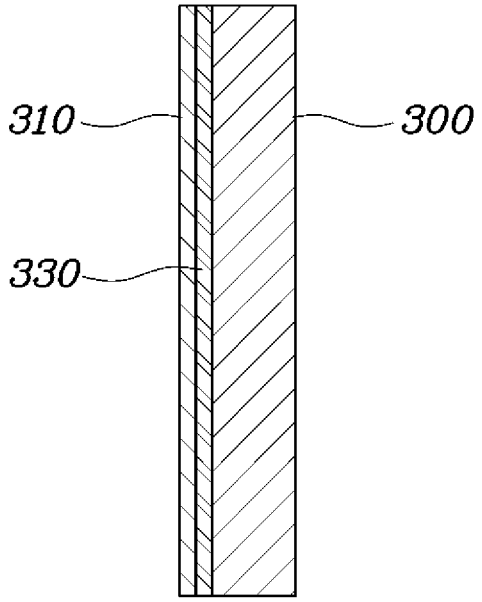

FIGS. 3A and 3B are views showing radio-wave-transmissive covers of vehicle radars according to the other embodiments of the present invention.

As shown in FIG. 3A, in the transmissive cover, that is, in the substrate 300, the protective layer 320 for protecting the optical film 310 may be formed on an opposite surface of the surface of the optical film 310 that faces the substrate 300, among the two surfaces of the optical film 310. The protective layer 320 may include a transparent resin or an opaque resin.

Further, as shown in FIG. 3B, in the transmissive cover, that is, in the substrate 300, the protective layer 330 for protecting the optical film 310 may be formed on the surface of the optical film 310 that faces the substrate 300, among the two surfaces of the optical film 310. The protective layer 330 may include a transparent resin.

Example

Hereinafter, the present invention will be described with reference to Comparative Examples and Examples.

First, in order to compare Comparative Examples in which an optical film was conventionally formed using a single-film-forming material with an Example according to the present invention, the Comparative Example, in which only indium (In) was used as the film-forming material on the surface of a substrate, and the Example, in which both aluminum (Al) and indium (In) were used as the film-forming material, were prepared. In the Example, an amount of 84 at % of aluminum (Al) and an amount of 16 at % of indium (In) were used as the film-forming material.

Figure 4A:
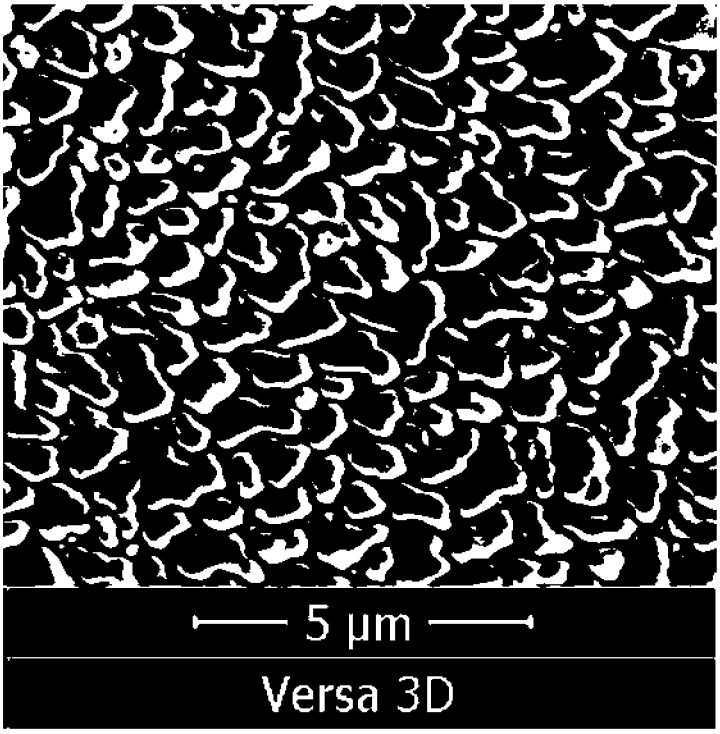
FIGS. 4A and 4B are SEM micrographs and mimetic diagrams showing radio-wave-transmissive covers in a Comparative Example and an Example according to an exemplary embodiment of the present invention.
Figure 4A:
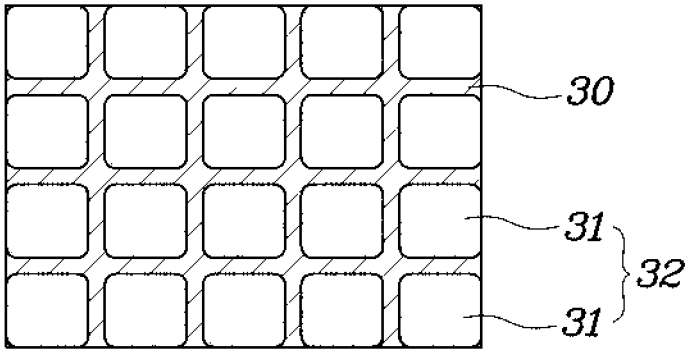
Figure 4B:
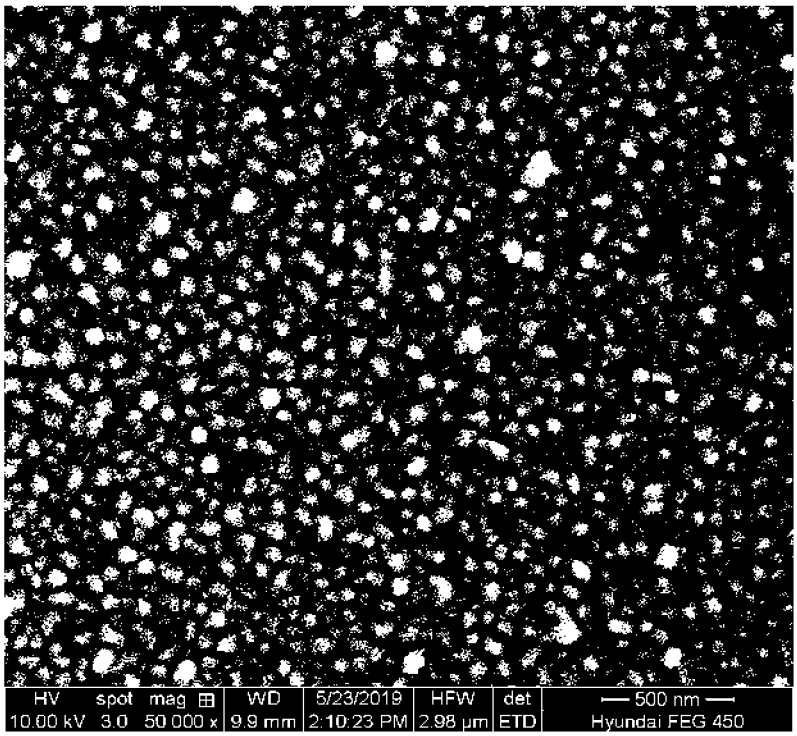
Figure 4B:
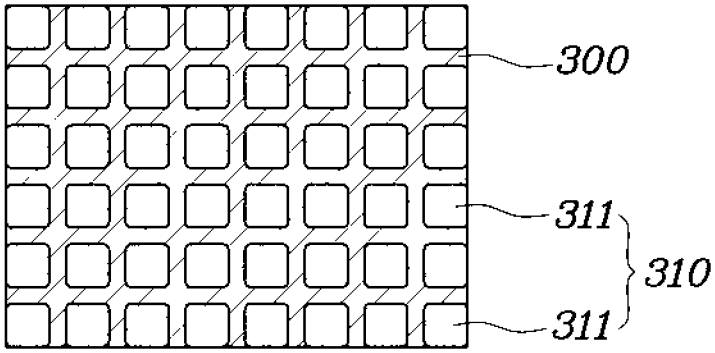

In addition, SEM images of the Comparative Example and the Example were taken, and the results are shown in FIGS. 4A and 4B. Further, the radio-wave transmission performance and hardnesses of the Comparative Example and the Example were measured.

The radio-wave transmission performance was measured at a frequency of 76.5 GHz using a radio-wave transceiving evaluation device including a network analyzer and an antenna. In addition, the value measured by the radio-wave transceiving evaluation device was used in the formula of dB (decibels) below to perform calculation. When the value in parentheses, that is, the value of $I/I_0$, was 0.95, the dB value was about −0.22 dB. Thus, it can be inferred that a propagation loss is 5%. Accordingly, it can be judged that the propagation loss is 5% or less when the dB value is −0.22 dB or less.

$$I\ (\text{dB}) = 10 \times \log_{10}[I/I_0] \ldots \text{dB (decibel)} \qquad \text{Formula}$$

I is the intensity of an output radio wave and $I_0$ is the intensity of an input radio wave.

In addition, the hardness of the optical film deposited on the substrate was measured according to a depth control method using a nanoindenter (ISO14577).

In FIGS. 4A and 4B, the mimetic views that are shown below the SEM images are schematically illustrated to facilitate understanding of the SEM images.

As shown in FIG. 4A, in the Comparative Example, in which only indium (In) was used as the film-forming material, since the size of the island structures 31 formed using the film-forming material 32 on the surface of the substrate 30 was increased, sufficient space for transmission of the radio wave was not secured, so the radio-wave transmission performance was reduced. In further detail, the size of the island structure formed using indium (In) was at a level of about 500 nm or more. As a result, the radio-wave transmission performance was measured to be −0.43 dB, indicating a propagation loss of about 10%. Further, the measured hardness of the Comparative Example was 0.122 GPa.

In contrast, as shown in FIG. 4B, in the Example, in which 84 at % of aluminum (Al) and 16 at % of indium (In) were used as the film-forming material, the size of the island structure 311 formed using the film-forming material 32 on the surface of the substrate 30 was 100 nm or less. As a result, the radio-wave transmission performance was measured to be −0.10 dB, indicating that a propagation loss was maintained at 5% or less. Further, the measured hardness of the Example was 0.152 GPa.

Therefore, the propagation loss and the hardness were better in the case of using both aluminum (Al) and indium (In) as the film-forming material than in the case of using only indium (In) as the film-forming material.

Further, a Comparative Example, in which only tin (Sn) was used as the film-forming material on the surface of the substrate, and an Example, in which both aluminum (Al) and tin (Sn) were used as the film-forming material, were prepared. In the Example, 60 at % of aluminum (Al) and 40 at % of tin (Sn) were used as the film-forming material.

Figure 5A:
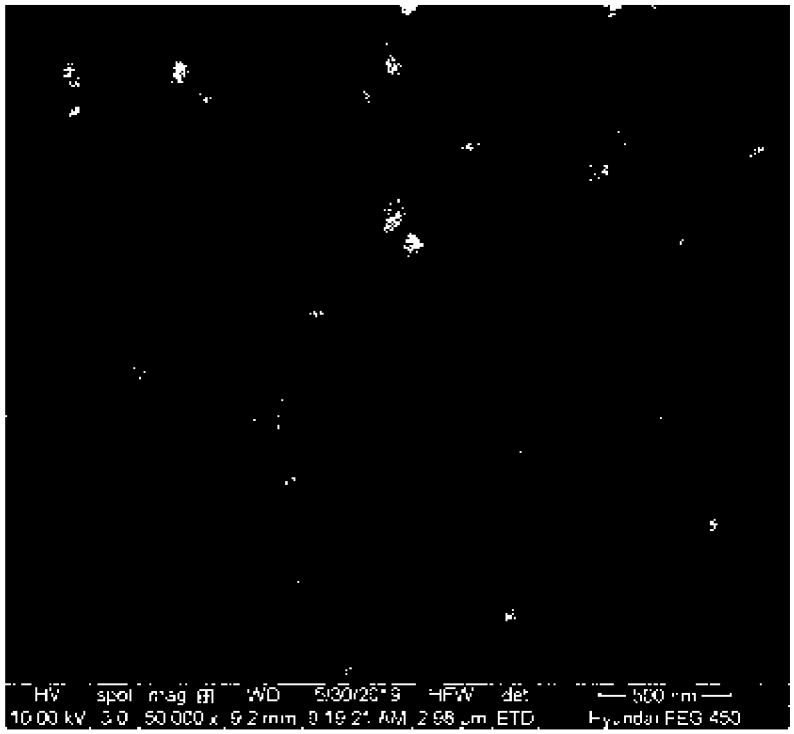
FIGS. 5A and 5B are SEM micrographs showing radio-wave-transmissive covers in a Comparative Example and an Example according to an exemplary embodiment of the present invention.
Figure 5B:
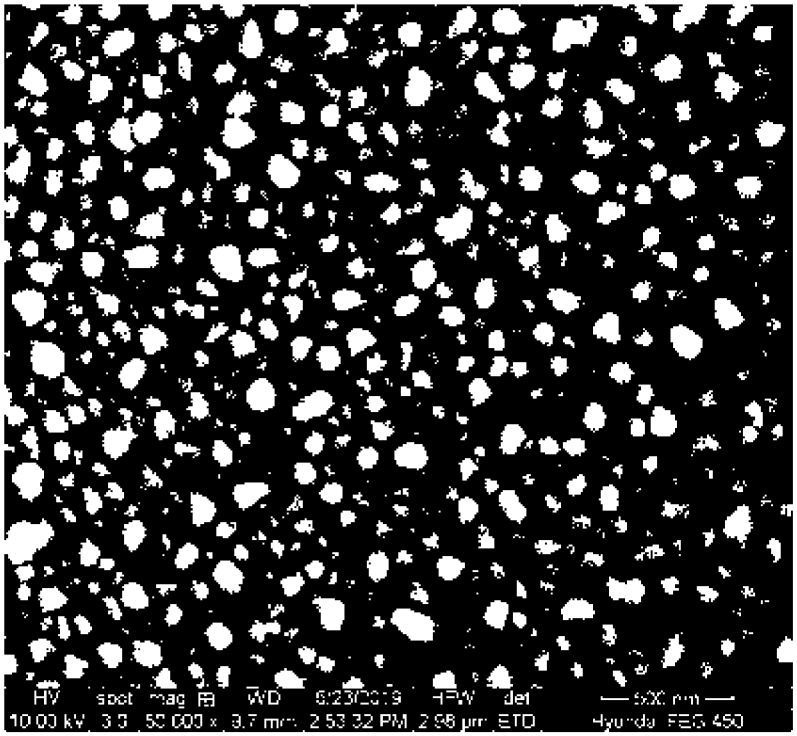

In addition, SEM images of the Comparative Example and the Example were taken, and the results are shown in FIGS. 5A and 5B. Further, the radio-wave transmission performance and hardnesses of the Comparative Example and the Example were measured.

As shown in FIG. 5A, the size of the island structure formed using tin (Sn) was at a level of about 500 nm or greater. As a result, the radio-wave transmission performance was measured to be −0.36 dB, indicating a propagation loss of about 8%. Further, the measured hardness of the Comparative Example was 0.253 GPa.

In contrast, as shown in FIG. 5B, in the Example in which 60 at % of aluminum (Al) and 40 at % of tin (Sn) were used as the film-forming material, the size of the island structure formed using tin (Sn) was 100 nm or less. As a result, the radio-wave transmission performance was measured to be −0.22 dB, indicating that a propagation loss was maintained at 5% or less. Further, the measured hardness of the Example was 0.305 GPa.

Therefore, the propagation loss and the hardness were better in the case of using both aluminum (Al) and tin (Sn) as the film-forming material than in the case of using only tin (Sn) as the film-forming material.

In the case where both aluminum (Al) and a low-melting-point metal were used as the film-forming material, an experiment was performed to determine the difference depending on the content ratio of aluminum (Al) to the low-melting-point metal.

Figure 6:
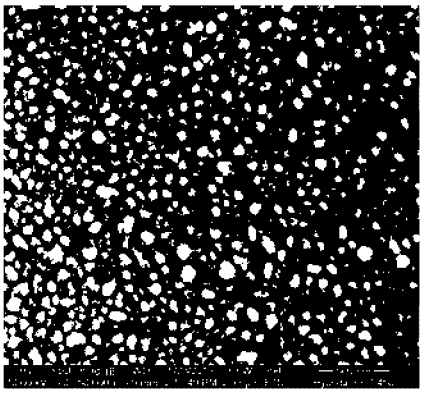
FIGS. 6 and 7 are SEM micrographs showing radio-wave-transmissive covers in the Comparative Examples and the Examples according to exemplary embodiments of the present invention, and are views showing a propagation loss value thereof.
Figure 6:
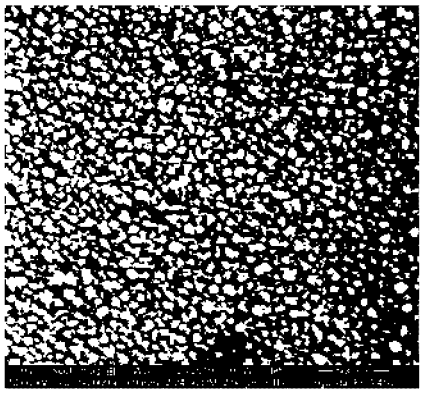
Figure 6:
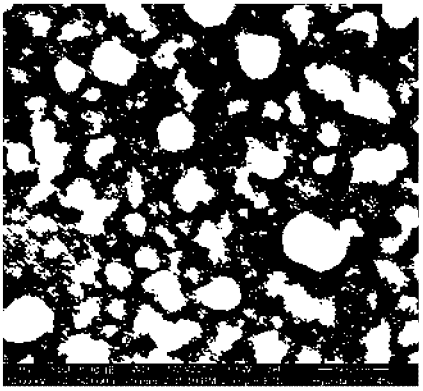
Figure 6:
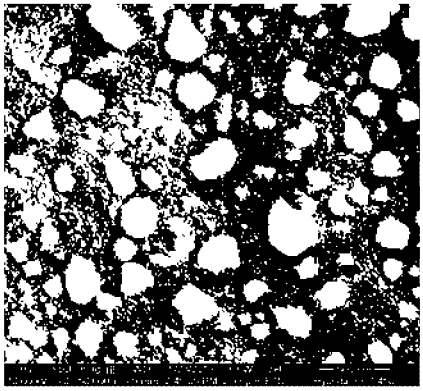

First, in the case when both aluminum (Al) and indium (In) were used as the film-forming material, in order to check the size of the island structure formed in the optical film and the radio-wave transmission performance depending on the ratio of aluminum (Al) to indium (In), the ratio of aluminum (Al) to indium (In) was changed as shown in FIG. 6, and the SEM micrograph of the optical film and the measurement result of radio-wave transmission performance are shown in FIG. 6.

As shown in FIG. 6, in samples #1 and #2, in which the ratio of aluminum (Al) and indium (In) satisfied the ratio of 70 to 85 at % of aluminum (Al) and 15 to 30 at % of indium (In), the size of the island structure formed using the film-forming material on the surface of the substrate was 100 nm or less. Further, a propagation loss (dB) was measured to be −0.16 dB and −0.10 dB in the samples #1 and #2, respectively, whereby the propagation loss was 5% or less.

However, in samples #3 and #4, the ratio of aluminum (Al) and indium (In) did not satisfy the ratio of 70 to 85 at % of aluminum (Al) and 15 to 30 at % of indium (In) but the content of indium (In) was low. After the island structure was formed using the film-forming material on the surface of the substrate, nuclear regeneration and coalescence were realized. Accordingly, a propagation loss (dB) was measured to be −29.61 dB and −32.91 dB in the samples #3 and #4, respectively, whereby the propagation loss was more than 5%.

Meanwhile, although not shown in FIG. 6, when the content of indium (In) was 36 at % and 47 at %, in excess of 30 at %, the propagation loss (dB) was measured to be −0.26 dB (94%) and −0.34 dB (92.5%), respectively. Accordingly, the propagation loss was more than 5%.

Figure 7:
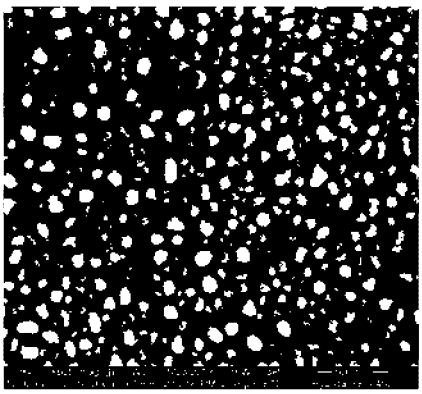
Figure 7:
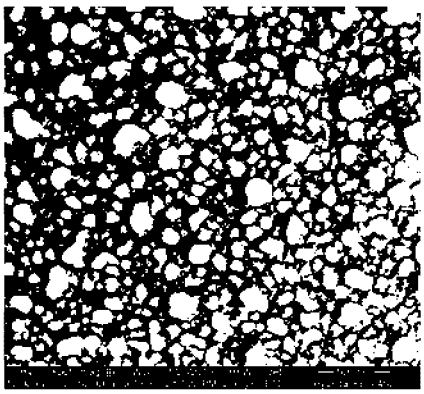
Figure 7:
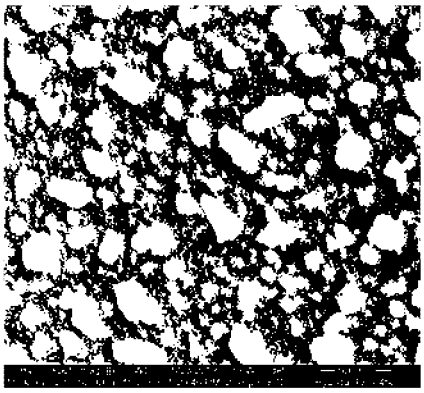
Figure 7:
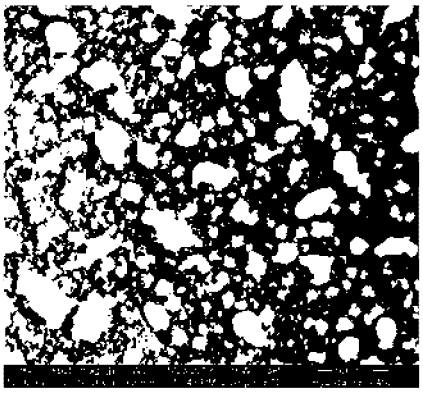

Next, in the case where both aluminum (Al) and tin (Sn) were used as the film-forming material, in order to check the size of the island structure formed in the optical film and the radio-wave transmission performance depending on the ratio of aluminum (Al) and tin (Sn), the ratio of aluminum (Al) to tin (Sn) was changed as shown in FIG. 7, and the SEM micrograph of the optical film and the measurement result of radio-wave transmission performance are shown in FIG. 7.

As shown in FIG. 7, in sample #5, in which the ratio of aluminum (Al) and tin (Sn) satisfied the ratio of 50 to 60 at % of aluminum (Al) and 40 to 50 at % of tin (Sn), the size of the island structure formed using the film-forming material on the surface of the substrate was 100 nm or less. Further, a propagation loss (dB) was measured to be −0.22 dB in the sample #5, whereby the propagation loss was 5% or less.

However, in samples #6, #7, and #8, the ratio of aluminum (Al) and tin (Sn) did not satisfy the ratio of 70 to 85 at % of aluminum (Al) and 40 to 50 at % of tin (Sn) but the content of tin (Sn) was low. After the island structure was formed using the film-forming material on the surface of the substrate, nuclear regeneration and coalescence were realized. Accordingly, a propagation loss (dB) was measured to be −16.61 dB, −28.02 dB, and −35.09 dB in the samples #6, #7, and #8, respectively, whereby the propagation loss was more than 5%.

Meanwhile, although not shown in FIG. 7, when the content of tin (Sn) was 67 at % and 78 at %, in excess of 50 at %, the propagation loss (dB) was measured to be −0.28 dB (93.5%) and −0.30 dB (93%), respectively. Accordingly, the propagation loss was greater than 5%.

Although the present invention has been described with reference to the accompanying drawings and various exemplary embodiments described above, the present invention is not limited thereto, but is defined by the appended claims. Accordingly, one of ordinary skill in the art may variously transform and modify the present invention without departing from the technical spirit of the appended claims.

What is claimed is:

1. A radio-wave-transmissive cover of a vehicle radar, comprising:

a substrate; and an optical film comprising aluminum (Al) and a low-melting-point metal having a melting point less than a melting point of the aluminum (Al) on a surface of the substrate, wherein the low-melting point metal comprises indium (In); and wherein the optical film comprises an amount of about 70 to 85 at % of aluminum (Al) and an amount of about 15 to 30 at % of the indium (In).

2. The radio-wave-transmissive cover of the vehicle radar of claim 1, wherein the optical film is formed by depositing the aluminum (Al) and the low-melting-point metal together.

3. The radio-wave-transmissive cover of the vehicle radar of claim 1, wherein the optical film is arranged in a form of an island structure having a size of about 100 nm or less on the surface of the substrate.

4. The radio-wave-transmissive cover of the vehicle radar of claim 1, wherein a propagation loss of the radio wave transmitted through the optical film is about 5% or less.

5. The radio-wave-transmissive cover of the vehicle radar of claim 1, wherein the optical film has a silver color.

6. The radio-wave-transmissive cover of the vehicle radar of claim 1, further comprising a protective layer comprising a resin formed on one or both surfaces of the optical film.

7. A radio-wave-transmissive cover of a vehicle radar, comprising:

a substrate; and an optical film comprising aluminum (Al) and a low-melting-point metal having a melting point less than a melting point of the aluminum (Al) on a surface of the substrate; and wherein the low-melting point metal comprises tin (Sn); and wherein an optical film comprises an amount of about 50 to 60 at % of aluminum (Al) and an amount of about 40 to 50 at % of the tin (Sn).

8. The radio-wave-transmissive cover of the vehicle radar of claim 7, wherein the optical film is formed by depositing the aluminum (Al) and the low-melting-point metal together.

9. The radio-wave-transmissive cover of the vehicle radar of claim 7, wherein the optical film is arranged in a form of an island structure having a size of about 100 nm or less on the surface of the substrate.

10. The radio-wave-transmissive cover of the vehicle radar of claim 7, wherein a propagation loss of the radio wave transmitted through the optical film is about 5% or less.

11. The radio-wave-transmissive cover of the vehicle radar of claim 7, wherein the optical film has a silver color.

12. The radio-wave-transmissive cover of the vehicle radar of claim 7, further comprising a protective layer comprising a resin formed on one or both surfaces of the optical film.

* * * * *